US007048577B2

(12) United States Patent
Chung

(10) Patent No.: US 7,048,577 B2
(45) Date of Patent: May 23, 2006

(54) WATERPROOF SIGNAL SPLITTER

(75) Inventor: Jui-Huang Chung, I-Lan Hsien (TW)

(73) Assignee: Signal Cable System Co., Ltd., I-Lan Hsien (TW)

( * ) Notice: Subject to any disclaimer, the term of this patent is extended or adjusted under 35 U.S.C. 154(b) by 188 days.

(21) Appl. No.: 10/751,179

(22) Filed: Jan. 2, 2004

(65) Prior Publication Data

US 2004/0145428 A1 Jul. 29, 2004

(30) Foreign Application Priority Data

Jan. 8, 2003 (TW) ..... 92200295 U

(51) Int. Cl.
*H01R 9/05* (2006.01)

(52) U.S. Cl. ..... 439/578

(58) Field of Classification Search ..... 439/578, 439/579, 589, 622, 675
See application file for complete search history.

(56) References Cited

U.S. PATENT DOCUMENTS

| | | | | |
|---|---|---|---|---|
| 5,147,221 | A * | 9/1992 | Cull et al. | 439/585 |
| 6,071,144 | A * | 6/2000 | Tang | 439/426 |
| 6,524,132 | B1 * | 2/2003 | Nagai | 439/578 |
| 6,955,562 | B1 * | 10/2005 | Henningsen | 439/578 |

* cited by examiner

*Primary Examiner*—Phuong Dinh
(74) *Attorney, Agent, or Firm*—Dellett & Walters

(57) ABSTRACT

A waterproof splitter box includes a hollow casing with threaded sleeves integrally extending out of the hollow casing, plastic inserts each securely received in a corresponding one of the threaded sleeves, rubber plugs each having a top portion, a mediate portion and a bottom portion which is received in a corresponding one of the plastic inserts, connecting blades each extending into a corresponding one of the plastic inserts and out of the rubber plug which is received in the plastic insert and signal wires each extending and connecting to a corresponding one of the connecting blades for transmitting a signal. The engagement between the connecting blade and the rubber plug prevents moisture from entering the hollow casing so that the transmitted signal is steady.

16 Claims, 6 Drawing Sheets

WATERPROOF SIGNAL SPLITTER

BACKGROUND OF THE INVENTION

1. Field of the Invention

The present invention relates to a signal splitter, and more particularly to a waterproof signal splitter.

2. Description of Related Art

A signal splitter is used to split a single signal for two or more connectors so that devices connected to the connectors are able to receive the same signal simultaneously. With reference to FIG. 6, a conventional splitter includes a casing (60) and a seat (70) partially received in the casing (60) and having a pair of connecting plates (72) extending into the casing (60) so that a signal wire (80) is able to extend between the pair of connecting plates (72) to transmit a signal for further application.

When the conventional splitter is used, especially outdoors, moisture often seeps into the joint between the seat (70) and the casing (60) and thus causes the signal to become unsteady. That is, the transmitted signal easily suffers from interference by weather conditions when the conventional splitter is concerned.

To overcome the shortcoming, the present invention tends to provide an improved waterproof splitter to mitigate the aforementioned problems.

SUMMARY OF THE INVENTION

The primary objective of the present invention is to provide an improved splitter having a plastic insert received in each of the sleeves and a rubber plug also received in each of the sleeves and engaged with the plastic insert so that after the connecting blade received in the plastic insert is extended through the rubber plug, moisture is completely prevented from entering the casing of the splitter of the present invention so that the signal is steady and will not suffer interference otherwise caused by weather conditions.

Other objects, advantages and novel features of the invention will become more apparent from the following detailed description when taken in conjunction with the accompanying drawings.

DETAILED DESCRIPTION OF THE PREFERRED EMBODIMENT

Figure 1:
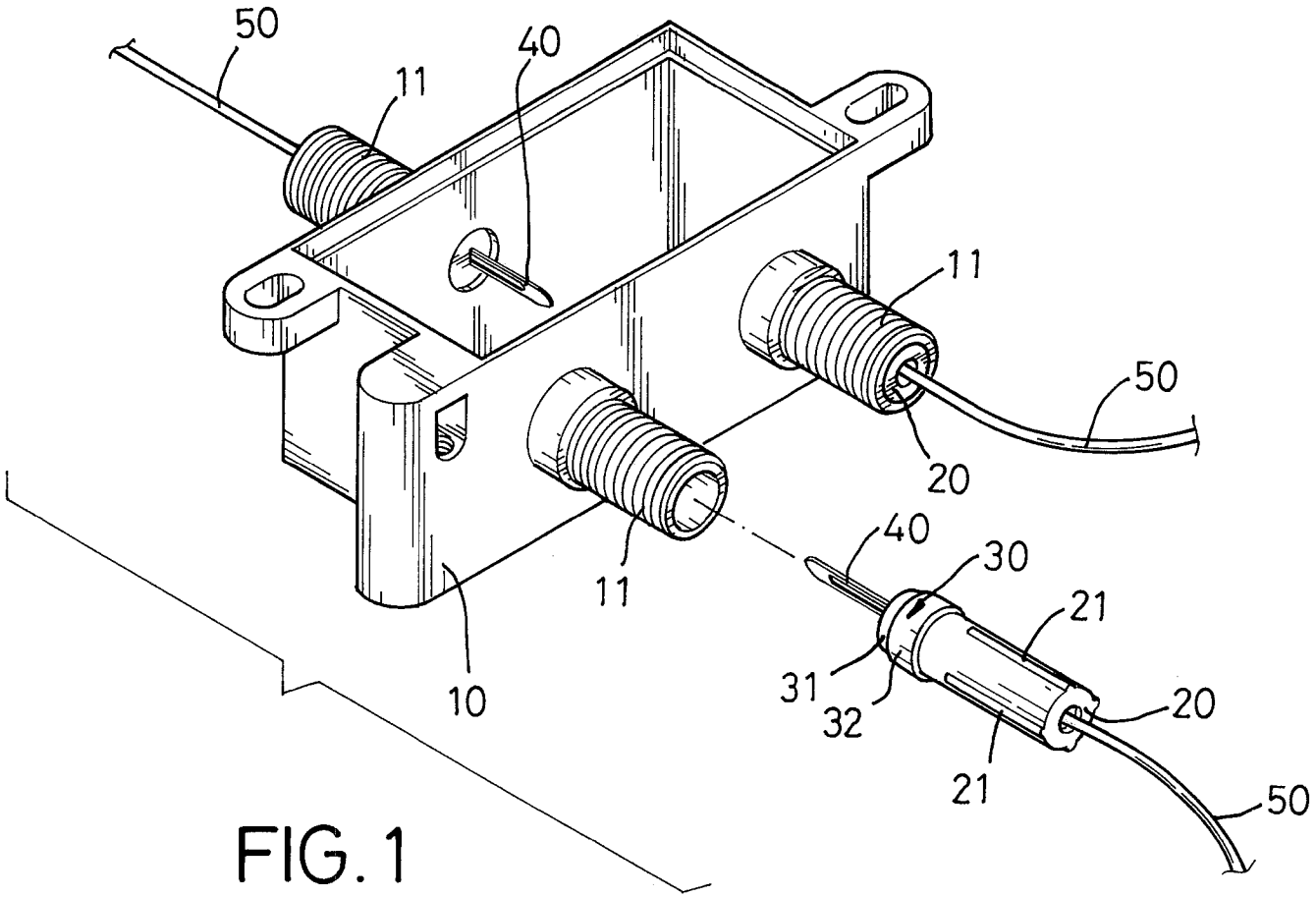
FIG. 1 is an exploded perspective view of the splitter of the present invention.

With reference to FIG. 1, the waterproof signal splitter in accordance with the present invention includes a hollow casing (10) with threaded sleeves (11) integrally extending out from side faces of the hollow casing (10), plastic inserts (20) each received in a corresponding one of the threaded sleeves (11), rubber plugs (30) each securely connected to a corresponding one of the plastic inserts (20) and connecting blades (40) respectively corresponding to one of the threaded sleeves (11) for connection with signal wires (50).

Figure 2:
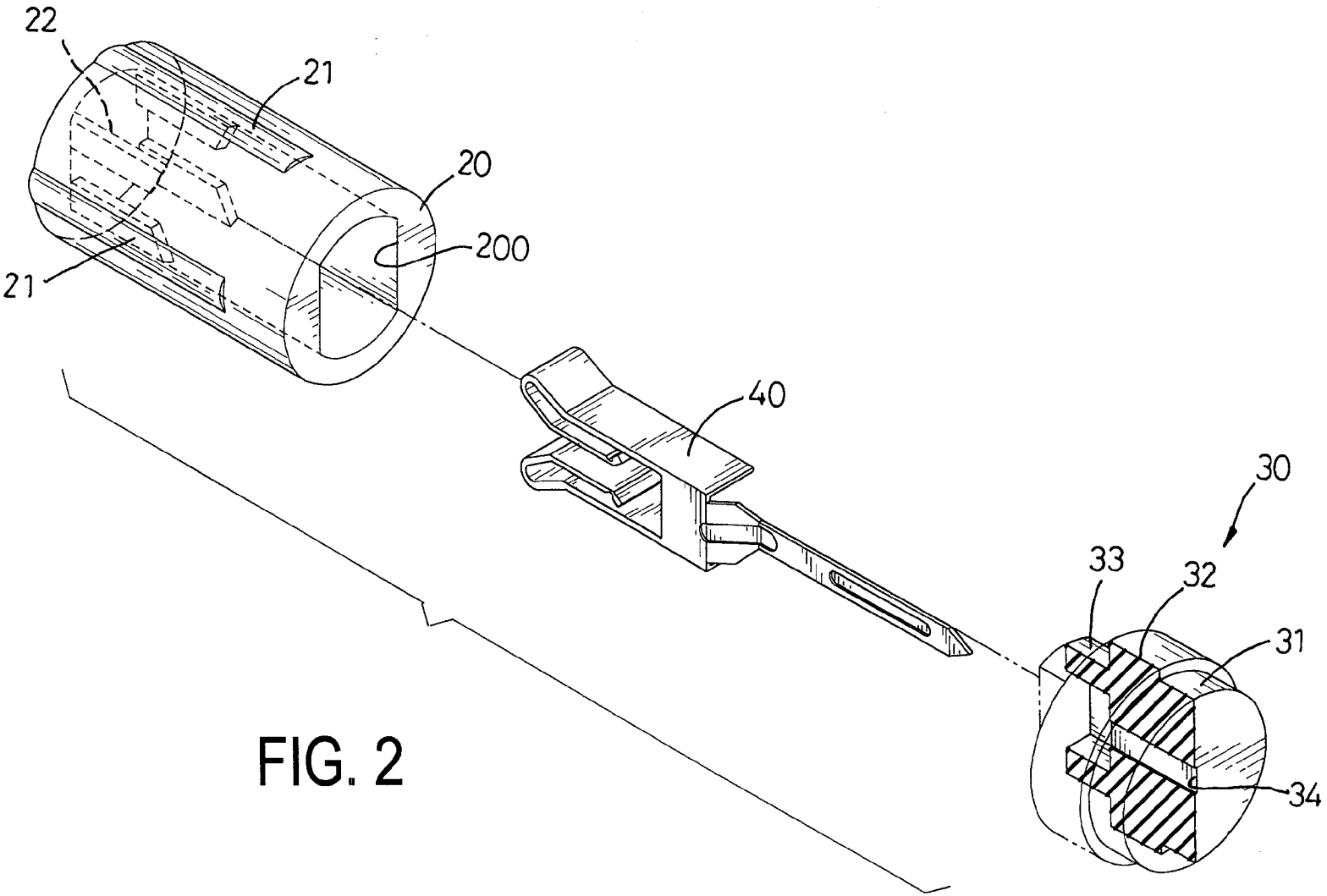
FIG. 2 is an exploded perspective view showing the plastic insert, the connecting blade and the rubber plug of the present invention.

With reference to FIG. 2, the plastic insert (20) is hollow to therefore define therein a tapered path (200) and has a diameter slightly smaller than an inner diameter of the threaded sleeve (11) so that the plastic insert (20) is able to be received in the threaded sleeve (11) in a watertight manner. The plastic insert (20) has ribs (21) longitudinally formed on an outer periphery of the plastic insert (20) and positioning plates (22) formed on an inner face of the plastic insert (20).

The rubber plug (30) has a top portion (31), a mediate portion (32) and a bottom portion (33). The mediate portion (32) has a diameter larger than those of the top portion (31) and the bottom portion (33). Further the top portion (31) has a diameter larger than a diameter of the bottom portion (33). The diameter of the bottom portion (33) is slightly smaller than the inner diameter of the plastic insert (20) so that the bottom portion (33) is able to extend into the path (200) of the hollow plastic insert (20) to have a watertight engagement with the inner surface of the tapered path (200). The extension of the rubber plug (30) into the plastic insert (20) is stopped by the mediate portion (32). Furthermore, the rubber plug (30) has a passage (34) longitudinally defined through the rubber plug (30).

The connecting blade (40) is made of metal and able to transmit a signal.

Figure 3:
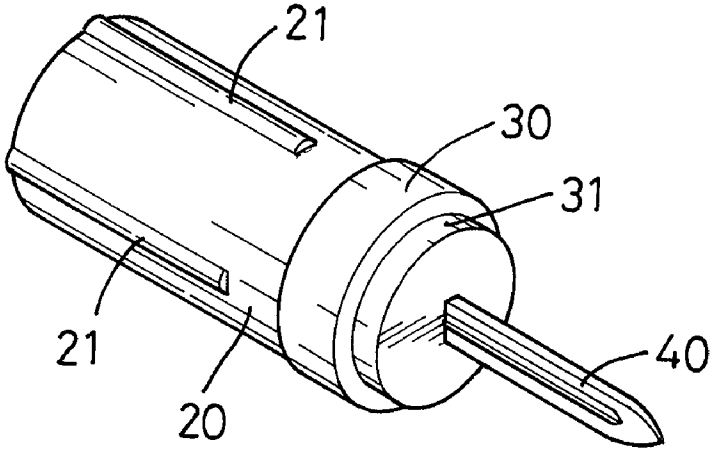
FIG. 3 is a perspective view showing the engagement between the plastic insert and the rubber plug.

With reference to FIG. 3, when the plastic insert (20), the rubber plug (30) and the connecting blade (40) are assembled, it is noted that the bottom portion (33) is received in the plastic insert (20) and the connecting blade (40) is extended out of the rubber plug (30) from the passage (34).

Figure 4:
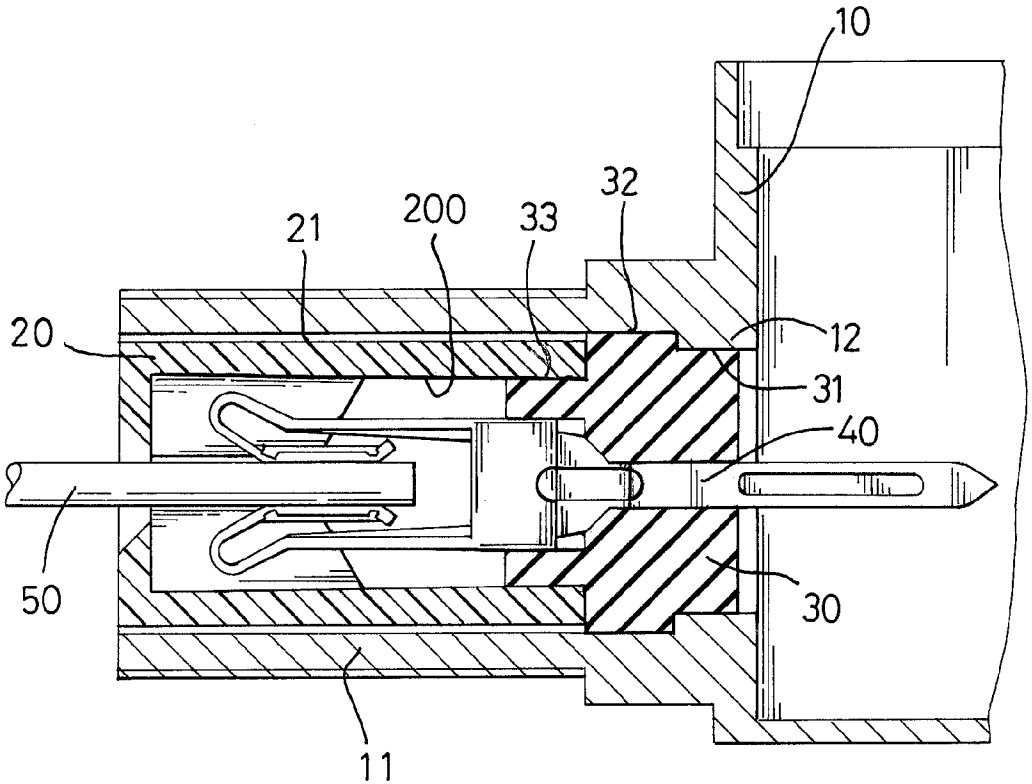
FIG. 4 is a schematic cross sectional view showing the assembly of the splitter of the present invention.
Figure 5:
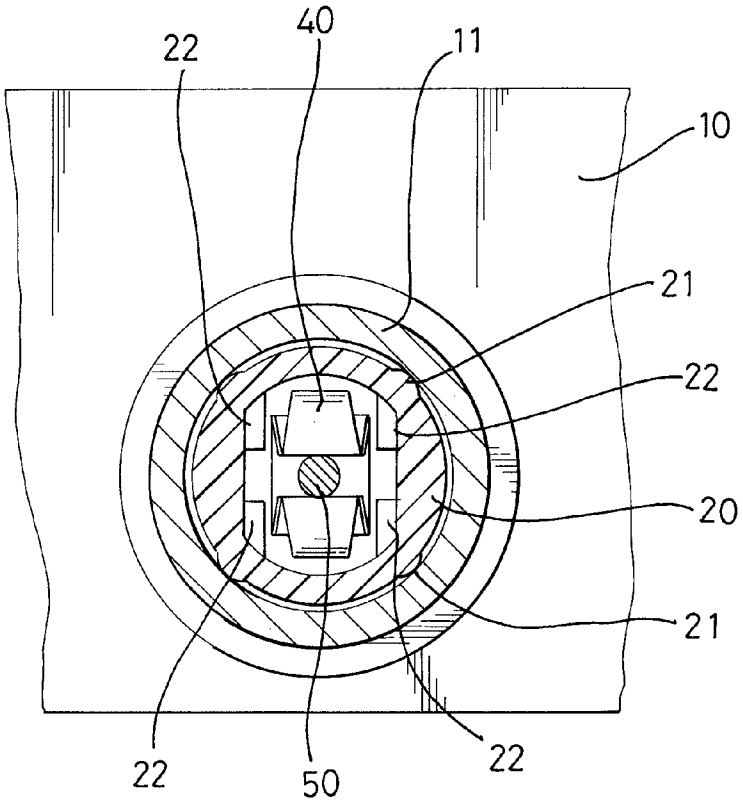
FIG. 5 is a cross sectional view showing the relative position between the plastic insert and the connecting blade inside the sleeve of the splitter of the present invention.
Figure 6:
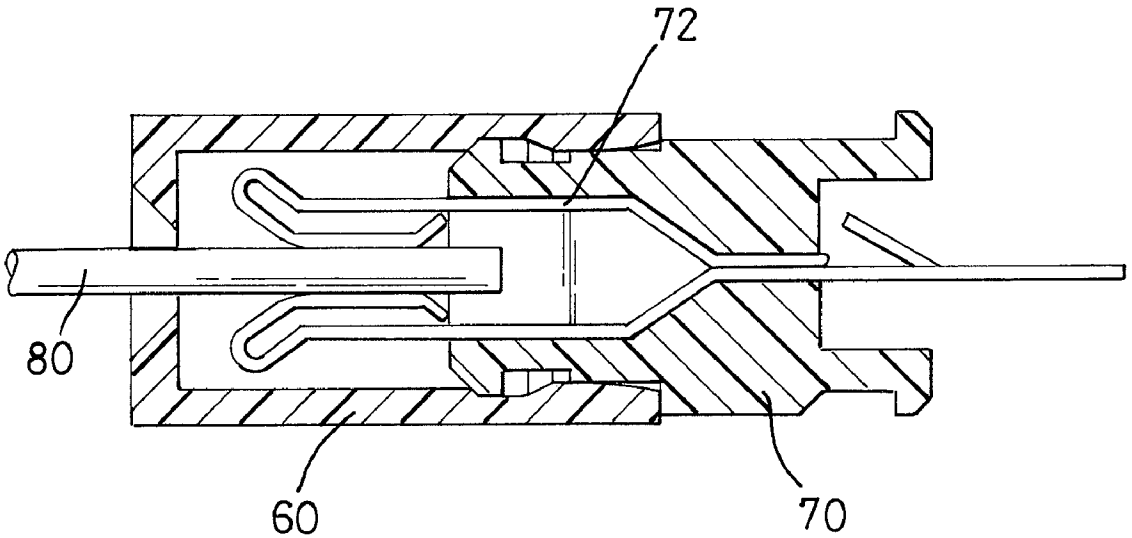
FIG. 6 PRIOR ART
FIG. 6 is a cross sectional view of a conventional splitter.

With reference to FIGS. 4 and 5 and still using FIG. 1 as a reference, it is to be noted that when the assembly shown in FIG. 3 is assembled with the hollow casing (10), the assembly including the plastic insert (20), the rubber plug (30) and the connecting blade (40) is extended into a corresponding threaded sleeve (11). After the extension of the connecting blade (40) into the plastic insert (20) and through the passage (34) of the rubber plug (30), because the passage (34) has a dimension smaller than a dimension of the connecting blade(40), an inner surface defining the passage (34) is able to have a watertight engagement with an outer surface of the connecting blade (40) and therefore to position the connecting blade (40) inside the rubber plug (30). Furthermore, the positioning plates (22) inside the plastic insert (20) are able to position the connecting blade (40) inside the plastic insert (20). Further, the ribs (21) on the outer periphery of the plastic insert (20) increase the friction with the inner face of the threaded sleeve (11). Thereafter, the signal wire (50) is able to be extended to connect to the connecting blade (40) for transmission of a signal.

It is appreciated that due to the addition of the plastic insert (20) and the rubber plug (30) and of course the extension of the connecting blade (40) directly extending through the rubber plug (30), moisture from the surrounding air is prevented from entering the hollow casing (10), and thus interference to the signal is avoided. Preferably, the positioning plates (22) are diametrically and diagonally formed inside the plastic insert (20) so as to provide efficient support to the connecting blade (40). Further, the threaded sleeve (11) has a step (12) formed on the inner face of the threaded sleeve (11) to correspond to the top portion (31) of the rubber plug (30) such that the rubber plug (30) is secured inside the threaded sleeve (11). Still further, the bottom portion (33) is configured to have a shape corresponding to a shape of the hollow plastic insert (20) such that after the bottom portion (33) is received in the plastic insert (20), the rubber plug (30) is immovable relative to the plastic insert (20).

It is to be understood, however, that even though numerous characteristics and advantages of the present invention, have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A waterproof splitter box comprising:

a hollow casing with threaded sleeves integrally extending out of the hollow casing;

plastic inserts each securely received in a corresponding one of the threaded sleeves and defined therein a path;

rubber plugs each received in the path of a corresponding one of the plastic inserts, wherein a mediate portion of the rubber plug has a diameter larger than a diameter of the bottom portion of the rubber plug and the diameter of the bottom portion is slightly smaller than a diameter of a corresponding threaded sleeve such that the bottom portion is able to be received in the corresponding threaded sleeve;

connecting blades each extending into a corresponding one of the plastic inserts and out of the rubber plug which is received in the plastic insert; and signal wires each extending and connecting to a corresponding one of the connecting blades for transmitting a signal, whereby engagement between the connecting blade and the rubber plug prevents moisture from entering the hollow casing so that the transmitted signal is steady.

2. The waterproof splitter box as claimed in claim 1, wherein a top portion has a diameter larger than the diameter of the bottom portion yet smaller than the diameter of the mediate portion, the threaded sleeve has a step formed on an inner face of the threaded sleeve to correspond to the top portion of the rubber plug such that after the rubber plug is received in the corresponding threaded sleeve, the rubber plug is secured.

3. The waterproof splitter box as claimed in claim 1, wherein the plastic insert has ribs longitudinally formed on an outer periphery of the plastic insert such that after the plastic insert is received in the corresponding threaded sleeve, friction between the inner face of the threaded sleeve and the plastic insert is enhanced and thus the plastic insert is secured inside the threaded sleeve.

4. The waterproof splitter box as claimed in claim 2, wherein the plastic insert has ribs longitudinally formed on an outer periphery of the plastic insert such that after the plastic insert is received in the corresponding threaded sleeve, friction between the inner face of the threaded sleeve and the plastic insert is enhanced and thus the plastic insert is secured inside the threaded sleeve.

5. The waterproof splitter box as claimed in claim 1, wherein the plastic insert has positioning plates formed on an inner periphery of the plastic insert such that after the extension of the connecting blade, the positioning plates are able to secure the connecting blade inside the plastic insert.

6. The waterproof splitter box as claimed in claim 2, wherein the plastic insert has positioning plates formed on an inner periphery of the plastic insert such that after the extension of the connecting blade, the positioning plates are able to secure the connecting blade inside the plastic insert.

7. The waterproof splitter box as claimed in claim 3, wherein the plastic insert has positioning plates formed on an inner periphery of the plastic insert such that after the extension of the connecting blade, the positioning plates are able to secure the connecting blade, inside the plastic insert.

8. The waterproof splitter box as claimed in claim 4, wherein the plastic insert has positioning plates formed on an inner periphery of the plastic insert such that after the extension of the connecting blade, the positioning plates are able to secure the connecting blade inside the plastic insert.

9. The waterproof splitter box as claimed in claim 1, wherein the rubber plug has a passage longitudinally defined through the rubber plug to expedite the extension of the connecting blade, the bottom portion of the rubber plug is configured in such a way that after the bottom portion of the rubber plug is received in the hollow plastic insert, the rubber plug is immovable relative to the plastic insert.

10. The waterproof splitter box as claimed in claim 2, wherein the rubber plug has a passage longitudinally defined through the rubber plug to expedite the extension of the connecting blade, the bottom portion of the rubber plug is configured in such a way that after the bottom portion of the rubber plug is received in the hollow plastic insert, the rubber plug is immovable relative to the plastic insert.

11. The waterproof splitter box as claimed in claim 3, wherein the rubber plug has a passage longitudinally defined through the rubber plug to expedite the extension of the connecting blade, the bottom portion of the rubber plug is configured in such a way that after the bottom portion of the rubber plug is received in the hollow plastic insert, the rubber plug is immovable relative to the plastic insert.

12. The waterproof splitter box as claimed in claim 4, wherein the rubber plug has a passage longitudinally defined through the rubber plug to expedite the extension of the connecting blade, the bottom portion of the rubber plug is configured in such a way that after the bottom portion of the rubber plug is received in the hollow plastic insert, the rubber plug is immovable relative to the plastic insert.

13. The waterproof splitter box as claimed in claim 5, wherein the rubber plug has a passage longitudinally defined through the rubber plug to expedite the extension of the connecting blade, the bottom portion of the rubber plug is configured in such a way that after the bottom portion of the rubber plug is received in the hollow plastic insert, the rubber plug is immovable relative to the plastic insert.

14. The waterproof splitter box as claimed in claim 6, wherein the rubber plug has a passage longitudinally defined through the rubber plug to expedite the extension of the connecting blade, the bottom portion of the rubber plug is configured in such a way that after the bottom portion of the rubber plug is received in the hollow plastic insert, the rubber plug is immovable relative to the plastic insert.

15. The waterproof splitter box as claimed in claim 7, wherein the rubber plug has a passage longitudinally defined through the rubber plug to expedite the extension of the connecting blade, the bottom portion of the rubber plug is configured in such a way that after the bottom portion of the rubber plug is received in the hollow plastic insert, the rubber plug is immovable relative to the plastic insert.

16. The waterproof splitter box as claimed in claim 8, wherein the rubber plug has a passage longitudinally defined through the rubber plug to expedite the extension of the connecting blade, the bottom portion of the rubber plug is configured in such a way that after the bottom portion of the rubber plug is received in the hollow plastic insert, the rubber plug is immovable relative to the plastic insert.

* * * * *